United States Patent [19]

Frank

[11] 4,217,075

[45] Aug. 12, 1980

[54] LOADER DEVICE AND METHOD OF MOUNTING

[76] Inventor: Eldon M. Frank, R.R. 1, P.O. Box 23, Lake View, Iowa 51450

[21] Appl. No.: 874,615

[22] Filed: Feb. 2, 1978

[51] Int. Cl.[2] ..... E02F 3/70

[52] U.S. Cl. ..... 414/686; 172/274; 414/786

[58] Field of Search ..... 214/131 A, 145 A, 152; 172/272, 273, 274, 275; 414/686, 786

[56] References Cited

U.S. PATENT DOCUMENTS

| | | | |
|---|---|---|---|
| 3,324,954 | 6/1967 | Westendorf | 214/131 A |
| 3,610,450 | 10/1971 | Demkiw | 214/131 A X |
| 3,912,095 | 10/1975 | Miller | 214/131 A |
| 3,939,997 | 2/1976 | Frank | 214/131 A |
| 3,991,890 | 11/1976 | Frank | 214/131 A |
| 4,033,469 | 7/1977 | Frank | 214/131 A |
| 4,051,962 | 10/1977 | Westendorf | 214/131 A |

*Primary Examiner*—L. J. Paperner
*Attorney, Agent, or Firm*—Kenyon & Kenyon

[57] ABSTRACT

A novel loading device capable of standing independently of the tractor and adapted to be pivoted on and off the tractor. The loader includes a frame having a pair of upright frame members. Each upright frame member has a lower portion adapted to be detachably mounted at a side of a tractor. The rearward end of a boom is pivotally connected to the upper portions of the upright members. A materials handling implement is operably connected to the forward end of the boom and means are provided for selectively moving the boom relative to the upright members. The frame further has a pair of spaced apart side frame members extending rearwardly of a cross frame member and rigidly attached to the upright members intermediate the upper and lower portions thereof. The frame still further includes a downwardly projecting frame support member rigidly fixed in a single position relative to the side frame members and the upright members and adapted to cooperate with the materials handling implement to support the loader independently of a tractor.

18 Claims, 16 Drawing Figures

FIG. 5
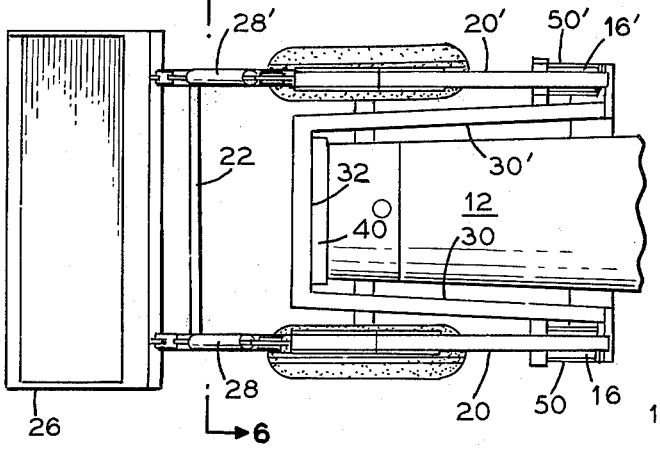
FIG. 6
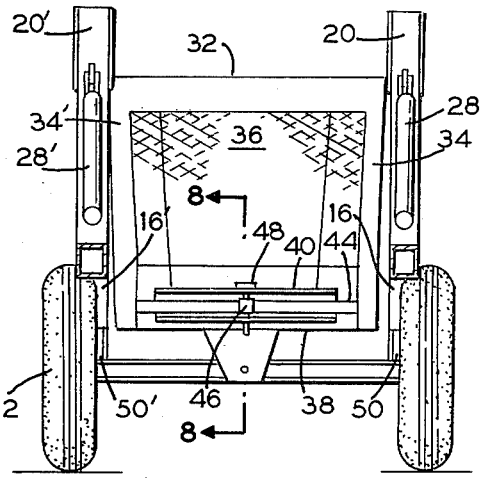
FIG. 7
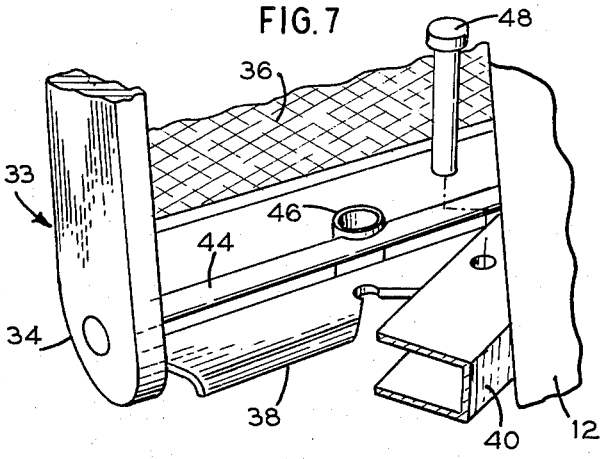
FIG. 8
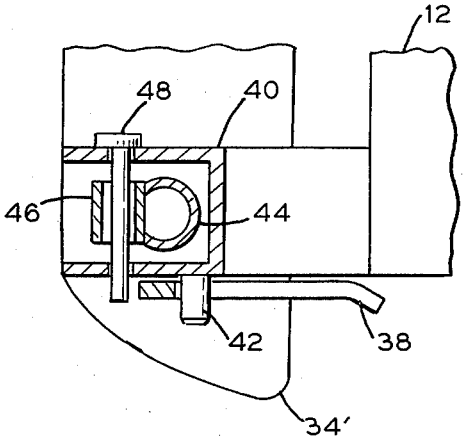
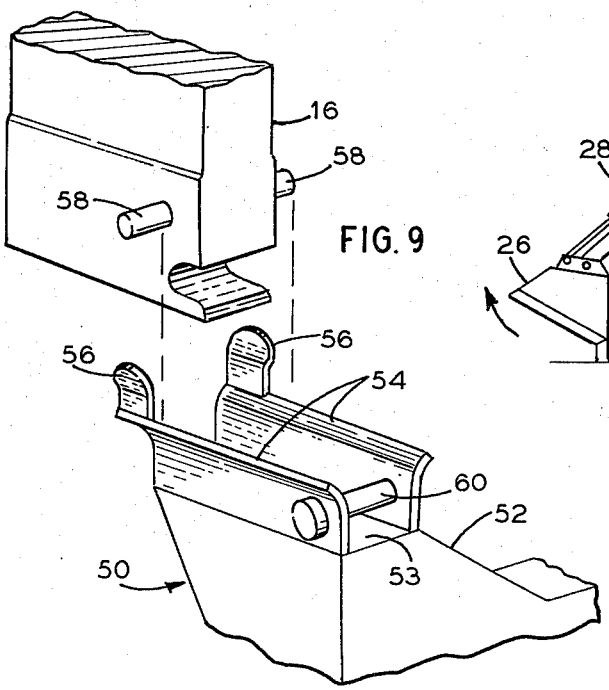
FIG. 9
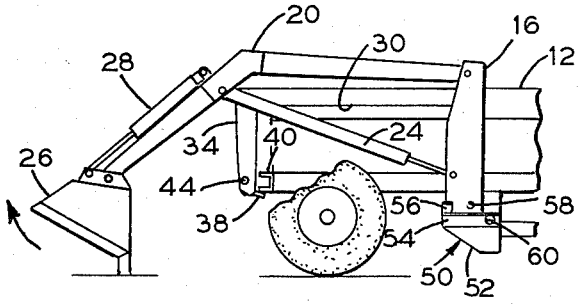
FIG. 10

LOADER DEVICE AND METHOD OF MOUNTING

BACKGROUND OF INVENTION

This invention relates to a loader device and more particularly to a detachable loader device, having a materials handling implement carried by a boom pivotally connected to a frame and adapted to be pivoted on and off the tractor.

Westendorf, in U.S. Pat. No. 3,324,954, has described such a loader device wherein the frame is adapted to engage and pivot about forward mounting brackets on the tractor until horizontal, then to slide rearwardly on the brackets as the tractor is driven forward and then to be secured in place.

I, in prior patents, including U.S. Pat. No. 4,033,469, and U.S. Pat. No. 3,939,997, have also described such as a loader device wherein the frame is supported by a stand and adapted to engage and pivot about the front of the tractor until the rearward end of the frame engages side support brackets, then to pivot about the side support brackets to a substantially horizontal position and to slide rearwardly to a secured position. The stand is adapted to be rotated forwardly and upwardly so as not to interfere with operation of the tractor-loader unit.

SUMMARY OF THE INVENTION

The present invention relates to a novel loader device capable of standing independently of the tractor and adapted to be pivoted on and off the tractor. The loader includes a frame having a pair of upright frame members. Each upright frame member has an upper portion and a lower portion adapted to be detachably mounted at a side of a tractor. The rearward end of a boom is pivotally connected to the upper portions of the upright members. A materials handling implement is operatively connected to the forward end of the boom. Also provided is means for selectively moving the boom relative to the upright members. The frame further has a pair of spaced apart side frame members extending rearwardly of a cross frame member and rigidly attached to the upright members intermediate the upper and lower portions thereof. The frame still further includes a downwardly projecting frame support member rigidly fixed in a single position relative to the side frame members and the upright members and adapted to cooperate with the materials handling implement to support the loader independently of a tractor.

The present invention further relates to a novel method of mounting a loader device of this type onto a tractor. The method includes positioning the frontal portion of a tractor adjacent the forward end of the frame and rotating the upright frame members downwardly relative to the frame support member until the lower portion of the upright members engage mounting brackets on the tractor. The frame is then rotated forwardly and upwardly about an axis through the lower portions of the upright members until the side frame members are in a substantially horizontal position. The loader is then detachably secured to the tractor.

Depending upon the mounting brackets employed, the step of detachably securing the loader to the tractor may include the sub-step of driving the tractor forward relative to the frame, thereby causing the frame to slide towards the rear of the tractor. Utilizing similar mounting brackets the rearward movement of the frame relative to the tractor may also be effectuated by forwardly rotating the materials handling implement relative to the boom. If a different set of mounting brackets is employed, detachably securing the loader to the tractor may include the sub-step of further rotating the side frame members through the horizontal position to a position where the side frame members are inclined downwardly from the forward end to the rearward end of the tractor and then reversing said rotation until the side frame members return to a substantially horizontal position.

DESCRIPTION OF THE DRAWINGS

In the drawings which illustrate preferred embodiments of the novel tractor loader device:

FIG. 5 is a top plan view of the loader device mounted on the tractor.

FIG. 6 is a cross-sectional view along section line 6—6 of FIG. 5.

FIG. 7 is an enlarged fragmentary perspective view of the front end mounting bracket shown in the foregoing figures and a portion of the loader device adapted for slidable mounting thereon.

FIG. 8 is a cross-sectional view taken along section line 8—8 of FIG. 6.

FIG. 9 is an enlarged fragmentary perspective view of a side mounting bracket shown in the foregoing figures and a portion of the loader device adapted for slidable mounting thereon.

FIG. 10 is a side elevation view of the implement and tractor illustrating the manner in which the loader device may be slidably mounted through rotation of the materials handling implement relative to the boom.

DESCRIPTION OF PREFERRED EMBODIMENTS

Figure 1:
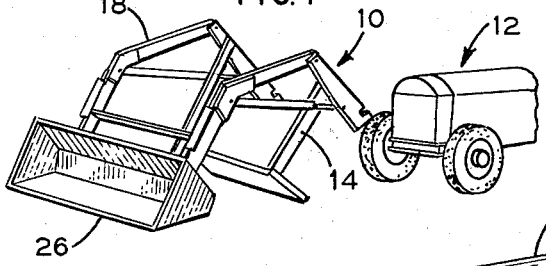
FIG. 1 is a perspective view of the loader device shown detached from the tractor.
Figure 2:
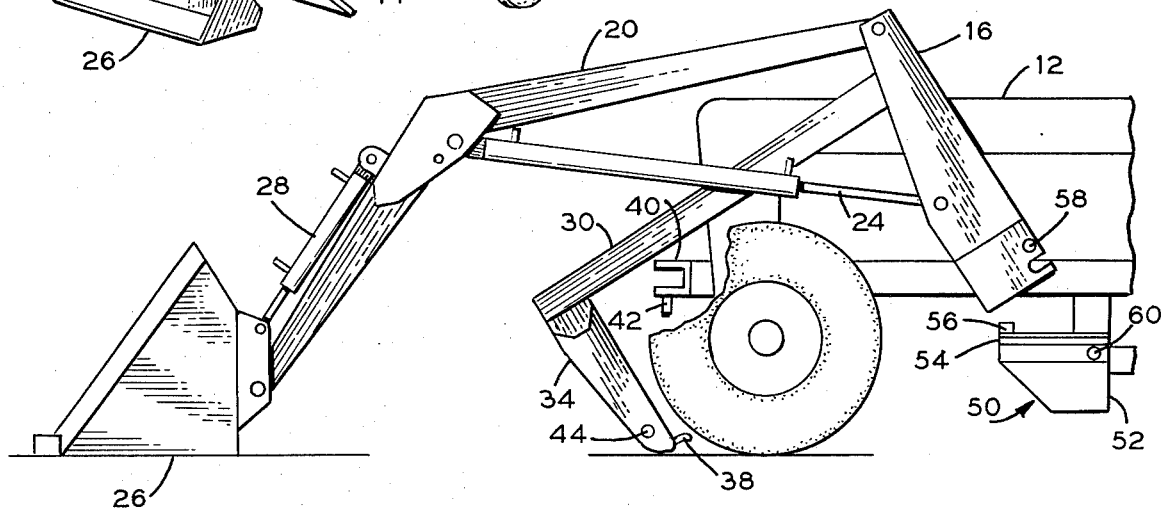
FIGS. 2 and 3 are side elevation views of the loader device and tractor adapted for slidable mounting of the loader device onto the tractor and illustrates sequential relationships therebetween during the mounting of the loader device onto the tractor.
Figure 3:
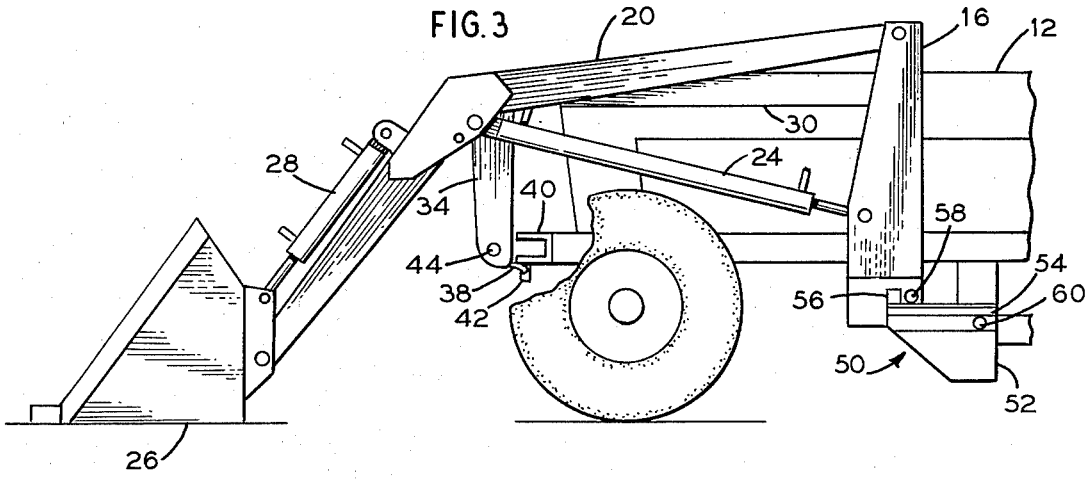
Figure 4:
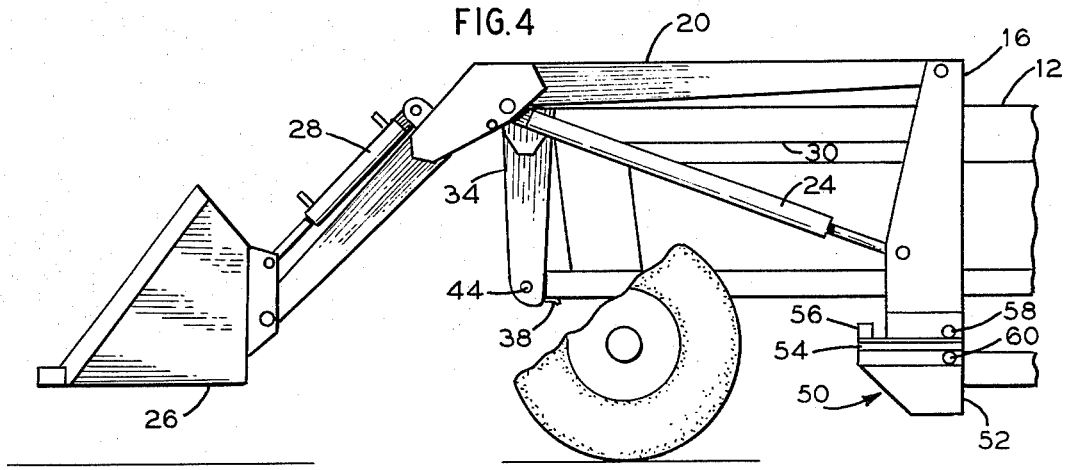
FIG. 4 is a side elevation view of the loader device and tractor illustrating the loader device in the mounted position on the tractor.

FIG. 1 illustrates the loader device 10 detached from the tractor 12 adapted to have the loader detachably mounted thereon.

The loader device 10 includes a frame 14 having a pair of upright frame members 16 and 16'. The loader device can also include the boom 18 illustrated as having a pair of boom arms 20 and 20' pivotally mounted at their rearward ends on the upper portions of the upright members 16 and 16'; a transverse member 22 extends between the boom arms 20 and 20' adjacent their forward ends. The loader device also includes a means for rotating the boom arms 20 and 20' relative to the upright members 16 and 16'. The boom rotating means is exemplified in the drawings as a set of hydraulic cylinders 24 and 24' extending between and operably connected to boom arms 20 and 20' and upright members 16 and 16'.

The loader device 10 further includes a materials handling implement pivotally mounted on the forward ends of the boom arms 20 and 20' and means for rotating the materials handling implement relative to the boom arms 20 and 20'. The materials handling implement is exemplified in the drawings as a bucket 26 and the implement rotating means as a second set of hydraulic cylinders 28 and 28' extending between and operably connected to the bucket 26 and the boom arms 20 and 20'. This set of hydraulic cylinders 28 and 28', like the first set of hydraulic cylinders 24 and 24' is adapted to be connected to the hydraulic system of the tractor 12.

The frame 14 also includes a pair of side frame members 30 and 30' extending rearwardly of a cross-frame member 32, the side frame members 30 and 30' being rigidly mounted at their rearward ends to the upright members 16 and 16' intermediate the upper and lower portions of the upright members 16 and 16'.

The frame 14 also includes a downward projecting support member rigidly affixed in a single position relative to the side frame members 30 and 30' and is adapted to cooperate with the materials handling implement to support the loader device 10 independently of the tractor 12. In the drawings, the support member 33 is shown as including a pair of downwardly projecting frame support legs 34 and 34' rigidly secured to the side frame members 30 and 30', as well as to the cross-frame member 32. The support member 33 is shown in the drawings as adapted to function as a radiator guard and is shown as having a grill structure 36, extending between the support legs 34 and 34'; the upper portion of grill structure 36 is attached to the cross-frame member 32.

The support member 33 is shown in the drawings as being adapted to be mounted on the forward end of the tractor 12. As best shown in FIGS. 7 and 8, a stop-guide plate 38 extends between support legs 34 and 34' on the lower portions thereof. The plate 38 is adapted to abut the lower face of a channel-like mounting bracket 40 affixed to the front of tractor 12. The plate 38 has a V-shaped channel to cooperate with guide pin 42 positioned on the lower face of bracket 40 to guide loader 10 onto tractor 12 during mounting. Located adjacent and above plate 38 is a bar 44 extending between support legs 34 and 34' adapted to be received by the mounting bracket 40. Rigidly mounted on the bar 44 is a sleeve 46 adapted to align with holes in brackets 40 and receive locking pin 48, which extends through the holes in bracket 40 and sleeve 46.

The side mounting bracket 50, adapted to receive the lower portion of upright member 16, is best shown in FIG. 9. Side mounting bracket 50' is substantially the same as side mounting bracket 50 and upright member 16 is substantially the same as upright member 16'; accordingly, only the side mounting bracket 50 and upright member 16 will be further discussed.

Bracket mount 52, attached to the side of tractor 12, forms the base wall 53 of bracket 50. Protruding upwardly from the base wall are side walls 54 forming a channel to receive the lower portion of upright member 16. Protruding upwardly from the frontal portion of the side walls 54 are guide-stops 56 adapted to cooperate with stop pins 58 on the upright member 16 to stop forward movement of the frame 14 during mounting of the loader 10. Side bracket locking pin 60 extends transversely between side walls 54 and is adapted to cooperate with a locking groove in upright member 16 to lock the mounted loader 10 in position on tractor 12. Utilizing the above described mounting means the loader 10 may be mounted by positioning the tractor 12 adjacent the cross-frame member 32. As will be recognized by one skilled in the art, the relative dimensions of the loader must be such that the lower portions of the upright members 16 and 16' can be sufficiently elevated to allow either the front axle or front wheels of tractor 12, depending on the width of the loader 10 with respect to tractor 12, to pass under the lower portions of upright members 16 and 16'.

After the tractor 12 is positioned adjacent to cross-frame member 32, the hydraulic cylinders 24 and 24' can be actuated to cause the boom arms 20 and 20' to converge with upright members 16 and 16'. Depending on the precise construction of the loader 10, support legs 34 and 34' will slide forward or bucket 26 will slide rearwardly; generally, it is most desirable to construct the loader 10 so that there is rearward movement of the bucket 26. In either case, the upright members 16 and 16' will rotate downwardly about an axis through the lower portions of the support legs 34 and 34' until the lower portions of upright members 16 and 16' engage the base walls 53 and 53' of side mounting brackets 50 and 50'. Further actuation of the hydraulic cylinders 24 and 24' will generally cause the upright members 16 and 16' to slide forward in the side mounting brackets 50 and 50' until stop-pins 58 engage guide-stops 56. Further actuation of the hydraulic cylinders 24 and 24' will cause the side frame members 30 and 30' to rotate forwardly and upwardly about an axis through the lower portion of upright members 16 and 16' until the side frame members 30 and 30' are in a substantially horizontal position. When side frame members 30 and 30' are in substantially horizontal position stop-guide plate 38 engages the lower face of channel bracket 40 to stop further upward movement of the frame 14 relative to the tractor 12.

The loader 10 is then secured to tractor 12 by driving tractor 12 forward to horizontally slide the loader 10 rearwardly with respect to tractor 12, or as shown in FIG. 10, by actuating the hydraulic cylinders 28 and 28' to cause the bucket 26 to rotate forwardly and upwardly with respect to boom arms 20 and 20', thereby forcing the loader 10 rearwardly on tractor 12. During rearward movement of the loader 10, upright members 16 and 16' slide in the channels defined by side mounting brackets 50 and 50' and stop-guide plate 38 in cooperation with guide pin 42 positions the forward portion of frame 14 relative to the tractor 12. Rearward movement of the loader 10 ceases when locking pins 60 and 60' engage locking grooves in upright members 16 and 16'. Locking pin 48 may then be inserted to secure the loader in position.

Removal of the loader 10 from the tractor 12 may be accomplished by following substantially the same procedure in reverse.

Figure 11:
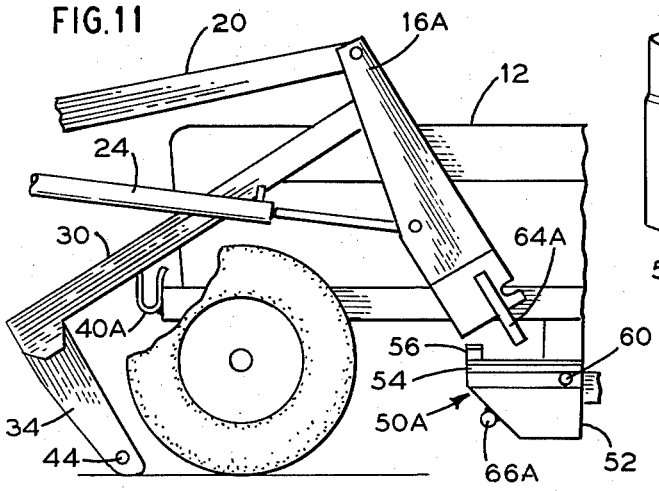
FIGS. 11 and 12 are side elevation views of the loader device and tractor adapted for mounting of the loader device onto the tractor solely through rotation of the boom relative to the frame and illustrates sequential relationships therebetween during the mounting of the loader device onto the tractor.
Figure 13:
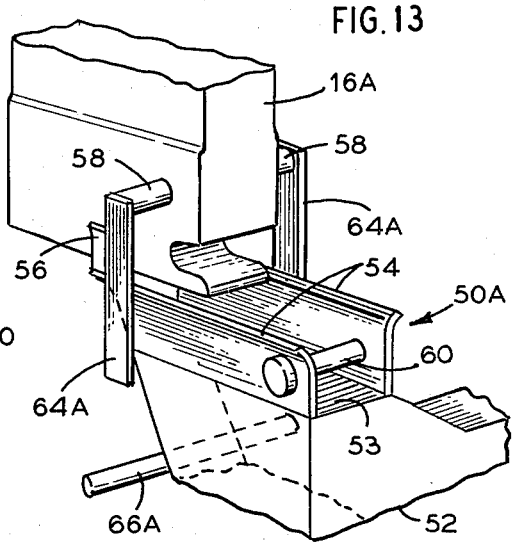
FIG. 13 is an enlarged fragmentary perspective view of the side mounting brackets shown in FIGS. 11 and 12 and a portion of the loader device to be detachably secured thereto.
Figure 12:
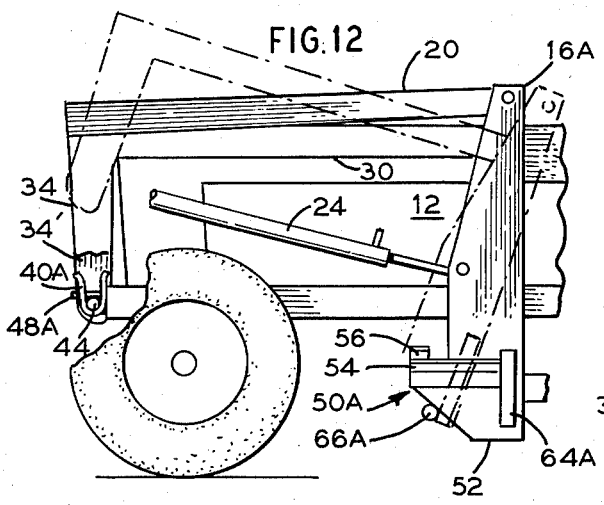

FIGS. 11, 12 and 13 illustrate an alternative mounting means. With respect to the forward mounting means, stop-guide plate 38 and the sleeve 46 have been removed from loader 10, and channel bracket 40 has been replaced with U-shaped bracket 40A. With respect to the side mounting means, as best shown in FIG. 13, the upright member 16 has been modified by adding downwardly projecting bars 64A to pins 58 and will be referred to as 16A. A horizontal stop bar 66A has been added to bracket mount 52 and the modified side mounting bracket 50 will be referred to as 50A.

Utilizing the above described mounting means, the tractor 12 is again positioned adjacent the cross-frame member 32 and again the hydraulic cylinders 24 and 24' are actuated to cause boom arms 20 and 20' to converge with respect to upright members 16A and 16A' thereby causing upright members 16A and 16A' to rotate downwardly about an axis through the lower portions of the support legs 34 and 34' until the lower portions of upright members 16A and 16A' engage the base walls 53 and 53' of side mounting brackets 50A and 50A'. Then as the cylinders 24 and 24' are further actuated, the side frame members 30 and 30' rotate forwardly and upwardly about an axis through the lower portions of upright members 16A and 16A' until the side frame members 30 and 30' are in a substantially horizontal position. Still further actuation of the cylinders 24 and 24' causes bars 64A and 64A' to engage stop bar 66A and 66A', thereby forcing loader 10 rearwardly relative to tractor 12 until upright members 16A and 16A' engage locking pins 60 and 60'. At this point cylinders 24 and 24' are actuated to reverse the rotation of frame 14 and to lower bar 38 into U-shaped bracket 40A. Locking pin 48A is then inserted through holes in bracket 40A to lock the loader in place.

To remove the loader when the above mounting means is employed, a substantially reverse procedure is employed, except that after frame 14 is elevated above the horizontal and while the side frame members 30 and 30' are inclined downwardly from the front to the rear of tractor 12, either the tractor 12 is driven rearward relative to the frame 14 or the bucket 26 is actuated to pull the loader 10 forward relative to tractor 12.

Figure 14:
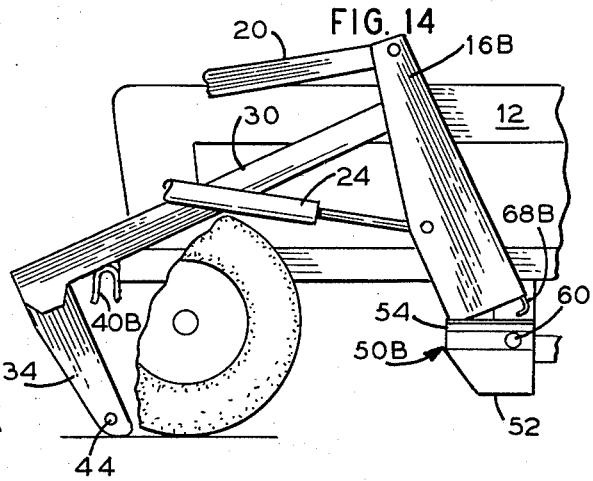
FIGS. 14 and 15 are side elevation views of the loader device and tractor adapted for mounting of the loader device onto the tractor solely through rotation of the boom relative to the frame and without any rearward sliding movement of the frame relative to the tractor and illustrates sequential relationships therebetween during attachment of the implement of the tractor.
Figure 15:
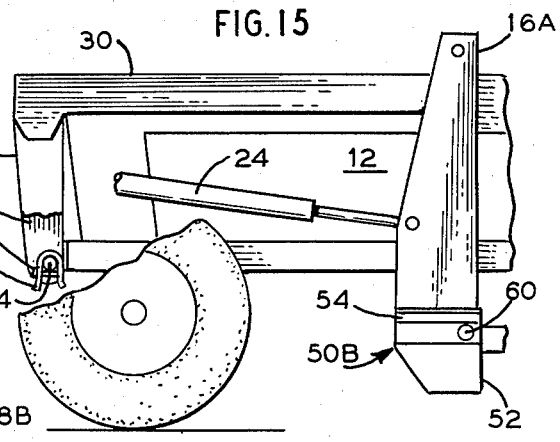
Figure 16:
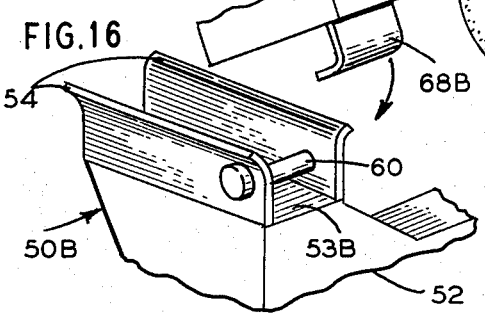
FIG. 16 is an enlarged fragmentary perspective view of one of the side mounting brackets shown in FIGS. 14 and 15 and the portion of the loader device to be secured thereby.

FIGS. 14, 15 and 16 illustrate a third mounting means. The front mounting means is the same as that shown in FIGS. 11, 12 and 13 except that the U-shaped tractor bracket has been inverted. In all other respects it is substantially the same as U-shaped bracket 40A and will be referred to as 40B.

With respect to the side mounting means, as best shown in FIG. 16, the upright member 16 has been modified to eliminate the locking grooves and stop pins 58 and further modified to add a locking hook 68B and will be referred to as 16B. Mounting bracket 50B is essentially the same as mounting bracket 50 except that guide-stops 56 have been eliminated and the base wall of the mounting bracket, designated 53B, has been modified to provide a stop-indentation (not shown).

Utilizing the mounting means shown in FIGS. 14, 15 and 16, the tractor 12 is again positioned adjacent the cross-frame member 32 and again the hydraulic cylinders 24 and 24' are actuated to cause boom arms 20 and 20' to converge with respect to upright members 16B and 16B', until the lower portions of upright members 16B and 16B' engage the stop indentations in the base walls 53B and 53B'. Then as the cylinders 24 and 24' are further actuated, the side frame members 30 and 30' will rotate forwardly and upwardly about an axis through the lower portions of upright frame members 16B and 16B'. Initially, during rotation, the lower portions of upright members 16B and 16B' will not move forward, however, as the upright members 16B and 16B' become more vertical, the lower portions of 16B and 16B' will slip from the indentations in base walls 53B and 53B' and slide forward thereby causing locking hooks 68B and 68B' to engage side bracket locking pins 60 and 60'. When side frame members 30 and 30' are in a substantially horizontal position, bar 44 will engage U-shaped bracket 40B to stop further rotation. Locking pin 48B may then be inserted into bracket 40B to secure the loader in position.

Removal of the loader 10 from tractor 12, when these mounting means are employed, may be accomplished by following substantially the same procedure in reverse.

To summarize, the method of mounting a loader device of this type onto a tractor includes positioning the frontal portion of the tractor adjacent the forward end of the frame and rotating the upright frame members downwardly relative to the frame support member until the lower portion of the upright members engage side mounting brackets on the tractor. The frame is then rotated forwardly and upwardly about an axis through the lower portions of the upright members until the side frame members are in a substantially horizontal position. The loader is then detachably secured to the tractor.

Other embodiments of this invention will, of course, be apparent to those skilled in the art.

What is claimed is:

1. A method for mounting a loader device on a tractor wherein said tractor has mounting brackets including a pair of side mounting brackets, and wherein said loader device includes a frame having a pair of spaced-apart side frame members each having the rearward end rigidly attached to upright frame members intermediate the upper and lower portions thereof, a boom having a rearward end pivotally connected to said upper portions of said upright frame members, and a materials handling implement pivotally connected to the forward end of said boom, said lower portions of said upright frame members each being adapted to be detachably mounted to one of said side mounting brackets, said frame further having a downwardly projecting support member adapted to cooperate with said materials handling implement to support said loader independently of said tractor comprising the following steps:

positioning the forward end of said tractor adjacent said support member;

rotating said upright members downwardly about an axis through the lower portion of said support member until said lower portions of said upright members contacts said side mounting brackets;

moving said materials handling implement with respect to said support member while said upright members are rotated downwardly;

rotating said side frame members about an axis through the lower portions of said upright members until said frame is in a substantially horizontal position; and detachably securing said loader device on said tractor.

2. The method of claim 1, wherein said step of detachably securing said loader device on said tractor includes the sub-step of rotating said materials handling implement relative to said boom so that said upright members are moved rearwardly on said tractor.

3. The method of claim 1, wherein said step of detachably securing said loader device on said tractor includes the sub-step of driving said tractor forward with respect to the loader device thereby causing said upright members to move rearwardly on said tractor.

4. The method of claim 1, wherein said step of detachably securing said loader on said tractor includes the following sub-steps:

further rotating said side frame members about said axis through the lower part of said upright members until said side frame members are inclined downwardly from the forward end to the rearward end of said tractor; and then rotating said side frame members in a reverse direction about the axis through the lower part of said upright members until said side frame members are again in a substantially horizontal position.

5. A loader device in combination with a tractor, comprising:

a tractor;

a rigid frame, including a pair of upright frame members each having a lower portion detachably mounted at a side of said tractor, a pair of spaced apart side frame members each having the rearward end attached to said upright frame members intermediate the upper and lower portions thereof, means connecting said spaced apart side members to one another, and a downwardly projecting support member having the upper end thereof connected to the forward portion of said side frame members and being of a length sufficient to engage the ground and act as a support for said frame in the unloaded position and being sufficiently out of ground engagement in the mounted position to facilitate operation of said tractor without disengagement of said support member;

a boom having its rearward end operatively connected to said uppoer portions of said upright members;

a materials handling implement operatively connected to the forward end of said boom; and means for detachably securing said loader on said tractor.

6. The combination of claim 5 further including means for selectively rotating said boom relative to said upright members.

7. The combination of claim 5 further including means for selectively rotating said materials handling implement relative to said boom.

8. The combination of claim 5 wherein said means for detachably securing said loader on said tractor includes a pair of side mounting brackets and a forward mounting bracket and wherein said side frame members are substantially horizontal and said downwardly projecting support member is substantially vertical when mounted to said tractor.

9. The combination of claim 5 wherein said means for detachably securing said loader on said tractor includes side mounting means for stopping forward sliding of said upright members relative to said tractor during mounting of said loader onto said tractor.

10. The combination of claim 5 wherein said support member includes a downwardly projecting support leg rigidly affixed in a single position relative to said side frame members and relative to said upright members and adapted to cooperate with said materials handling implement to support said loader device independently of said tractor.

11. The combination of claim 5 wherein said support member includes a pair of downwardly projecting support legs rigidly affixed in a single position relative to one another, relative to said side frame members and relative to said upright members and adopted to cooperate with said materials handling implement to support said loader device independently of said tractor.

12. A tractor loader device, comprising:

a rigid frame, including a pair of upright frame members each having a lower portion adapted to be detachably secured to a side of a tractor, a cross frame member spaced from said upright frame members, a pair of spaced apart side frame members connected to and extending rearwardly of said cross frame member and attached at the other end to said upright frame members intermediate the upper and lower portions thereof at a point adjacent the upper portion thereof, and a downwardly projecting support member having one end thereof connected to said cross frame member and the other end thereof adapted to serve in the unmounted position as a support for said frame and in the mounted position being sufficiently above ground level to facilitate operation of the tractor without disengagement of said downwardly projecting support member;

a boom having its rearward end operatively connected to said upper portions of said upright members; and a materials handling implement operatively connected to the forward end of said boom.

13. The tractor loader device of claim 12 further including means for selectively rotating said boom relative to said upright members.

14. The tractor loader device of claim 12 further including means for selectively rotating said materials handling implement relative to said boom.

15. The tractor loader device of claim 12 wherein said support member includes a downwardly projecting support leg rigidly affixed in a single position relative to said frame members and relative to said upright members and adopted to cooperate with said materials handling implement to support said loader device independently of said tractor.

16. The tractor loader device of claim 12 wherein said support member includes a pair of downwardly projecting support legs rigidly affixed in a single position relative to one another, relative to said side frame members and relative to said upright members and adopted to cooperate with said materials handling implement to support said loader device independently of said tractor.

17. A method for mounting a loader device on a tractor wherein said tractor has mounting brackets including a pair of side mounting brackets, and wherein said loader device includes a frame having a pair of spaced-apart side frame members each having the rearward end rigidly attached to upright frame members intermediate the upper and lower portions thereof, a boom having a rearward end pivotally connected to said upper portions of said upright frame members, and a materials handling implement pivotally connected to the forward end of said boom, said lower portions of said upright frame members each being adapted to be detachably mounted to one of said side mounting brackets, said frame further having a support member adapted to cooperate with said materials handling implement to support said loader independently of said tractor comprising the following steps:

positioning the forward end of said tractor adjacent said support member;

rotating said upright members downwardly about an axis through the lower portion of said support member until said lower portion of said upright members contacts said side mounting brackets;

rotating said side frame members about an axis through the lower portion of said upright members until said U-shaped frame is in a substantially horizontal position; and detachably securing said loader device on said tractor by rotating said materials handling implement relative to said boom so that said upright members are moved rearwardly on said tractor.

18. A method for mounting a loader device on a tractor wherein said tractor has mounting brackets including a pair of side mounting brackets, and wherein said loader device includes a frame having a pair of spaced-apart side frame members each having the rearward end rigidly attached to upright frame members intermediate the upper and lower portions thereof, a boom having a rearward end pivotally connected to said upper portions of said upright frame members, and a materials handling implement pivotally connected to the forward end of said boom, said lower portions of said upright frame members each being adapted to be detachably mounted to one of said side mounting brackets, said frame further having a support member adapted to cooperate with said materials handling implement to support said loader independently of said tractor comprising the following steps:

positioning the forward end of said tractor adjacent said support member;

rotating said upright members downwardly about an axis through the lower portion of said support member until said lower portion of said upright members contacts said side mounting brackets;

rotating said side frame members about an axis through the lower portion of said upright members until said U-shaped frame is in a substantially horizontal position;

further rotating said side frame members about said axis through the lower part of said upright members until said side frame members are inclined downwardly from the forward end to the rearward end of said tractor; and then rotating said side frame members in a reverse direction about the axis through the lower part of said upright members until said side frame members are again in a substantially horizontal position thereby detachably securing said loader device on said tractor.

* * * * *